United States Patent [19]

Sugita

[11] 4,335,803

[45] Jun. 22, 1982

[54] GANGWAY LADDER ARRANGEMENT

[75] Inventor: Toshimaru Sugita, Tokyo, Japan

[73] Assignee: Sugita Sangyo Kabushiki Kaisha, Japan

[21] Appl. No.: 164,577

[22] Filed: Jun. 30, 1980

[30] Foreign Application Priority Data

Jun. 29, 1979 [JP] Japan ..... 54-90631[U]

[51] Int. Cl.[3] ..... E06C 5/04

[52] U.S. Cl. ..... 182/12; 182/68; 182/127

[58] Field of Search ..... 182/1, 12, 13, 63, 127, 182/68, 36, 164; 14/72.5, 71.1, 71.3

[56] References Cited

U.S. PATENT DOCUMENTS

| | | | |
|---|---|---|---|
| 592,182 | 10/1897 | Waterman | 182/12 |
| 1,106,074 | 8/1914 | Bidlake | 14/72.5 |
| 3,910,264 | 10/1975 | Mahieu | 182/63 |
| 4,035,861 | 7/1977 | Edge | 14/72.5 |
| 4,157,742 | 6/1979 | Aanensen | 182/1 |
| 4,209,077 | 6/1980 | Yui | 182/36 |

FOREIGN PATENT DOCUMENTS

| | | | |
|---|---|---|---|
| 2701885 | 8/1977 | Fed. Rep. of Germany | 182/1 |
| 193796 | 1/1965 | Sweden | 182/1 |

*Primary Examiner*—Reinaldo P. Machado
*Attorney, Agent, or Firm*—Robert E. Burns; Emmanuel J. Lobato; Bruce L. Adams

[57] ABSTRACT

A gangway ladder arrangement used to provide a passage for a crew or operating personnel across a quay and a vessel berthing against the quay comprises a basement frame anchored to the quay, and a truck mounted on the basement frame so as to be movable toward or away from the vessel. A gangway ladder having a downwardly curved forward end has its other end mounted on the truck so as to be tiltable relative to the latter.

14 Claims, 5 Drawing Figures

GANGWAY LADDER ARRANGEMENT

FIELD OF THE INVENTION

The invention relates to a gangway ladder arrangement which is disposed between a marine vessel berthing alongside the quay of a port and the latter for allowing a passage of crew or loading personnel.

The elevation of the main deck of the vessel from the sea level depends on the size of the vessel, and also varies with an increase or decrease in the load, in particular, for freight vessels. The change in the elevation may become as great as approximately 30 meters between when unloaded and when fully loaded. The relative elevation also depends on the ebb and flow of the tide.

When the relative elevation of the main deck of the vessel with respect to the quay varies, the gangway ladder which is utilized by a crew or loading personnel going across the quay and vessel must be changed in its angle of inclination in accordance with the relative elevation of the main deck with respect to the quay.

DESCRIPTION OF THE PRIOR ART

A conventional gangway ladder is illustrated in FIG. 4, and includes a body 1 which has its one end supported by a shaft 2 on a quay 11 with an adjustable angle of inclination $\theta$. One end of a subladder 3 is mounted on a shaft 4 on the other end of the body 1 with an adjustable angle of inclination. This end of the body 1 extends over a handrail 13 of a berthing vessel 12 so that the other end of the subladder 3 is located on the main deck 14 of the vessel 12. Accordingly, a crew can step up the subladder and walk down the body 1 to land on the quay 11. If the relative elevation of the main deck with respect to the quay varies in response to a change in a loading or the ebb and flow of tide, a jack, not shown, may be utilized to adjust the angle $\theta$ of inclination of the body 1 in accordance with the change in the elevation. However, with such construction, if the relative elevation of the main deck 14 with respect to the quay 11 increases, the body 1 will assume a steeper position, presenting a difficulty or risk in moving across the ladder body 1. Also, the height between the other end of the body 1 and the main deck 14 increases accompanying an increased angle of inclination of subladder 3, again presenting a difficulty in stepping up and down the subladder 3.

To eliminate such inconveniences, there has been proposed a tower 5 (FIG. 5) including a plurality of tiers, each of which is provided with a ladder body similar to the body 1. Each ladder body 1 is disposed to be slidable and tiltable toward the vessel 12. On its top, the tower 5 carries a crane beam 6 which extends toward the vessel 12, and a crane 7 is movably mounted on the crane beam 6 for suspension of the ladder body 1. With this arrangement, the ladder body 1 may be pulled forward by the crane 7 from a particular tier of the tower 5 which corresponds in elevation to the elevation of the main deck 14 with respect to the quay 11, thus avoiding an increased angle of inclination of the ladder body as illustrated in FIG. 4. However, as the elevation of the vessel varies greatly, the ladder body 1 must be retracted into the associated tier of the tower 5 and another ladder body pulled forward each time the elevation varies by a given increment. It will be seen that the resulting construction represents a very extensive and expensive structure.

SUMMARY OF THE INVENTION

It is an object of the invention to provide a gangway ladder arrangement capable of providing a freely variable angle of inclination as the relative elevation of a vessel with respect to a quay varies.

It is another object of the invention to provide a gangway ladder arrangement which is simple in construction while permitting a safe passage of crew or passengers for an increased elevation of a vessel with respect to a quay.

In accordance with the invention, there is provided a gangway ladder arrangement for providing a passage between a quay and a vessel, comprising a basement frame anchored to the quay, a truck assembly mounted on the basement frame so as to be movable toward or away from the vessel, a gangway ladder having its one end mounted on the truck assembly in a tiltable manner and having its other end curved downwardly, and a controller for controlling the movement of the truck assembly and the tilting movement of the gangway ladder.

In a preferred embodiment of the invention, a platform extending in a direction perpendicular to the end face of the quay is mounted on the basement frame, and is provided with guide rails which extend lengthwise thereof. The truck assembly runs on the guide rails. The truck assembly is fixedly connected to part of an endless chain which is driven by a reversible motor placed on the basement frame. The endless chain extend along the guide rails, and by controlling the drive of the reversible motor, the location of the truck assembly can be established at any point desired. The gangway ladder may assume an angle of inclination which is controlled by a winch assembly mounted on the basement frame. A portion of the gangway ladder located adjacent to the other end thereof is curved downwardly with an angle which is greater than 90° and less than 180°. The curvature is sufficient to permit an access of the other end of the gangway ladder to the main deck while avoiding an interference as by the handrail mounted on the main deck if the vessel is unloaded or if the elevation of the quay rises as a result of the high tide. A rear subladder is disposed between the one end of the gangway ladder and the base surface of the truck assembly to provide a communication between the platform and the ladder through the truck assembly. A front subladder has its one end pivotally connected with the front end of the gangway ladder and has its other end disposed in abutment against the main deck of the vessel.

DESCRIPTION OF THE PREFERRED EMBODIMENT

Figure 1:
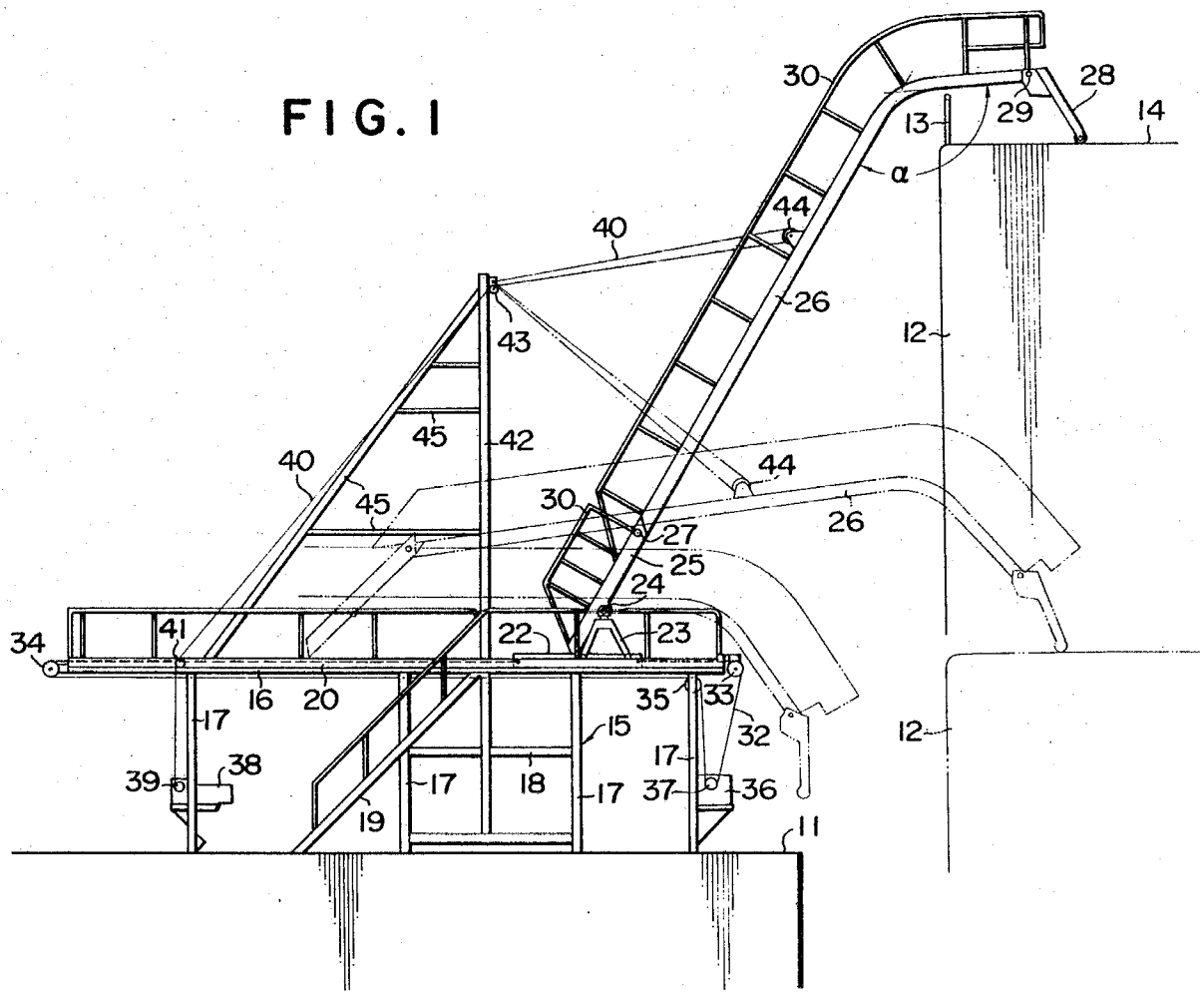
FIG. 1 is a side elevation of the gangway ladder arrangement according to one embodiment of the invention.
Figure 2:
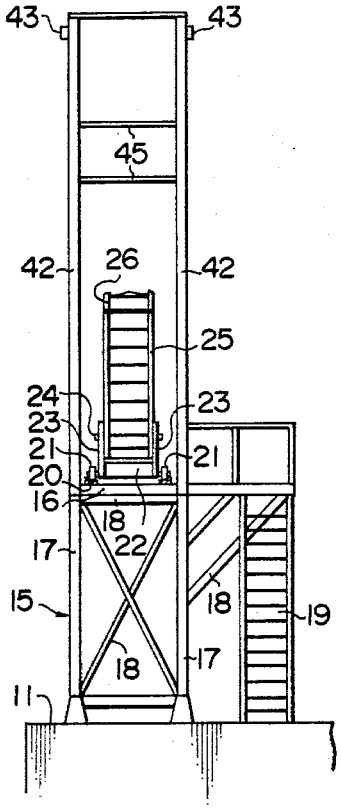
FIG. 2 is a rear view, partly removed, of the arrangement shown in FIG. 1.
Figure 3:
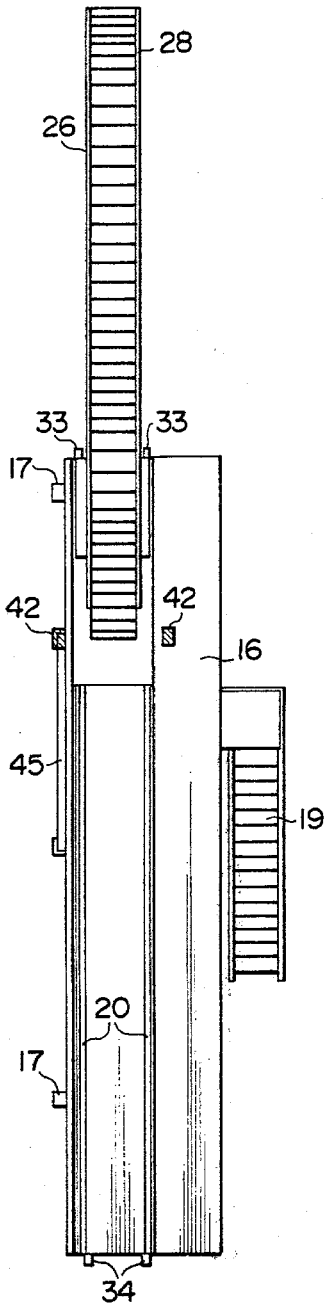
FIG. 3 is a plan view, partly removed and partly broken away, of the arrangement shown in FIG. 1.
Figure 4:
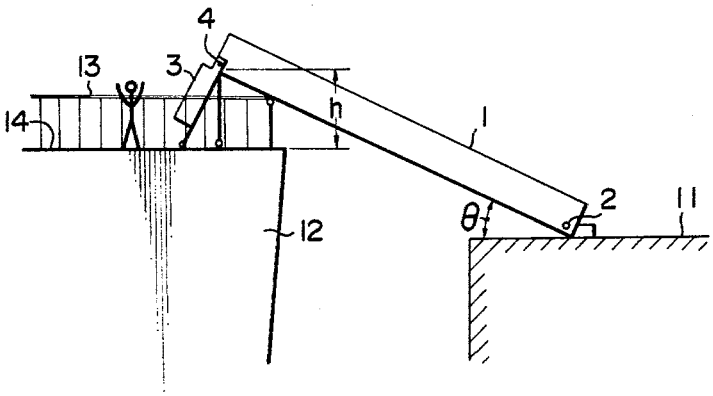
FIG. 4 PRIOR ART
FIGS. 4 and 5 are schematic views illustrating conventional gangway ladder arrangements.
Figure 5:
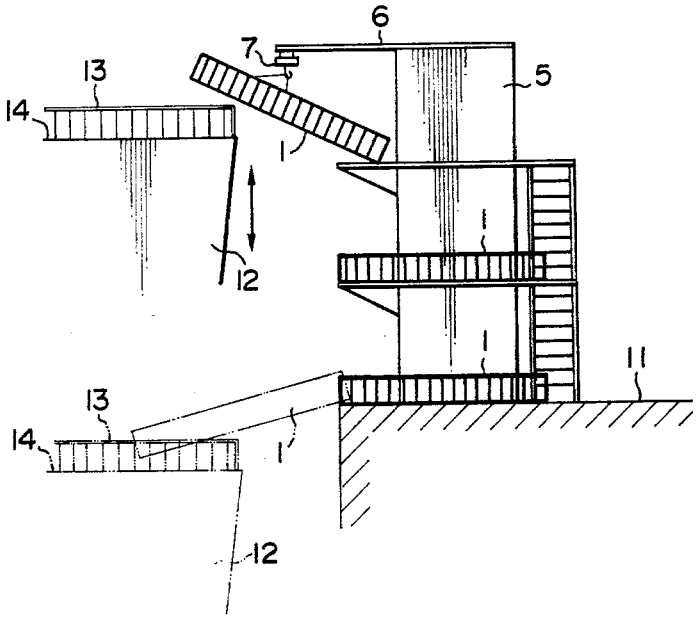
FIG. 5 PRIOR ART

Referring to FIGS. 1 to 3, there is shown a quay 11 on which a basement frame generically designated by reference numeral 15 is mounted. The basement frame 15 comprises a plurality of stanchions 17 and braces 18 for supporting a platform 16 which extends in a direction perpendicular to the end face of the quay 11. A staircase 19 is mounted on the basement frame 15 to permit a crew or passenger to ascend the platform 16 from the quay 11. A pair of guide rails 20 are disposed lengthwise along one side of the platform 16, and a truck 22 carrying wheels 21 are placed on the guide rails so that the wheels 21 can roll therealong. A pair of inverted V-shaped support frames 23 are mounted on the truck 22 and are spaced apart parallel to the direction of movement of the truck 22. A support shaft 24 has its opposite ends secured to the apex of the pair of support frames 23 and carries a lower subladder 25, with its lower end bearing against the truck 22 with a desired angle of inclination with respect to the latter. The upper end of the lower subladder 25 is pivotally connected with one end of a gangway ladder 26 by means of a connecting shaft 27. It is to be noted that the gangway ladder 26 may freely assume an angle of inclination which is less than the angle of inclination of the lower subladder 25, but whenever the ladder 26 assumes an angle of inclination greater than that of the subladder 25, the latter is forced to assume the same angle of inclination as the gangway ladder 26. This is achieved by providing bevelled surfaces on the front end of the frame of the lower subladder 25 and the lower end of the side frame of the gangway ladder 26 which are disposed in abutment against each other. A portion of the gangway ladder 26 adjacent to the upper end thereof is curved downwardly or in an arcuate form so as to ride past the handrail 13 fixedly mounted on the main deck 14 of the vessel 12. The ladder 26 is curved with an angle $\alpha$ which is greater than 90° and less than 180°. The upper end of the gangway ladder 26 is pivotally connected with one end of an upper subladder 28 by means of a support shaft 29, and the other end of the upper subladder 28 is located on the main deck 14. It will be noted that both the lower subladder 25 and the gangway ladder 26 are formed with handrails 30, 31 along their opposite sides.

A pair of endless chains 32 are disposed along the respective guide rails 20, and the truck 22 is connected to part of the chains. The pair of endless chains 32 extend around sprocket wheels 33, 34 rotatably disposed on the opposite longitudinal ends of the platform 16, and also around a guide sprocket 35 rotatably mounted on one of the stanchions 17. These chains are driven by their meshing engagement with a drive sprocket 37 mounted on the output shaft of a reversible motor 36 which is mounted on one of the stanchions 17 located nearer the vessel 12. A winch 38 is mounted on another stanchion 17 which is located on the opposite side from the stanchion 17 on which the motor 36 is mounted. The winch 38 includes a drive drum 39, to which one end of a wire 40 is anchored. The wire 40 extends around a sheave 41 rotatably mounted on the guide rail 20, another sheave 43 rotatably mounted on the free end of a stanchion 42, and a further sheave 44 rotatably mounted on the gangway ladder 26 at a position toward the upper subladder 28, and its other end is anchored to the free end of the stanchion 42. It will be seen that the stanchion 42 extends to an elevation higher than the stanchions 17, and is located at a position offset toward the vessel 12 relative to the middle of the platform 16 as considered lengthwise thereof. A plurality of braces 45 are provided to strengthen the stanchion 42.

When the gangway ladder arrangement is not in use, the winch 38 is driven to bring the ladder 26 into a substantially horizontal position, and the reversible motor 36 is driven to move the truck 22 away from the vessel 12. In this manner, substantially the entire ladder 26 can be placed on top of the platform 16 in a horizontal position as indicated by phantom line in FIG. 1. It is preferred that the sheave 44 is then located nearer the vessel 12 than the stanchion 42. When the vessel 12 is berthing against the quay 11 in order to perform a loading operation, the motor 36 is driven for rotation in the opposite direction from that mentioned above, thereby driving the endless chains 32 in the opposite direction from the direction in which they are driven when retracting the gangway ladder. As a result, the truck 22 is driven toward the vessel 12. At the same time, the winch 38 is driven to wind up the wire 40 around the drive drum 39. In this manner, the gangway ladder 26 pivots about the support shaft 27. If the winding of the wire 40 is continued after the gangway ladder 26 assumes an angle of inclination which is equal to that of the lower subladder 25, both the ladder 26 and the lower subladder 25 tilt down about the support shaft 24. In this manner, the ladder 26 is allowed to tilt until the lower end of the upper subladder 28 rises above the handrail 13, whereupon the drive to the winch 38 is temporarily interrupted while the truck 22 is further driven toward the vessel 12 so that the upper end of the ladder 26 is located above the main deck 14. Subsequently, the drive drum 39 is rotated in the opposite direction to release the wire 40, and the reverse rotation of the drive drum 39 is stopped when the lower end of the upper subladder 28 bears against the main deck 14. Thereupon a passage is established from the platform 16 through the lower subladder 25, the gangway ladder 26 and the upper subladder 28 to the main deck 14. As shown in solid line in FIG. 1, the downward curvature of the forward end of the gangway ladder 26 permits the forward end of the ladder 26 to approach the main deck 24 while avoiding an interference by the handrail 13 even for an increased elevation of the main deck with respect to the quay 11, thus enabling a safe passage of a crew or operating personnel across the quay 11 and the vessel 12.

When the vessel 12 is loaded to reduce its elevation with respect to the quay 11, as shown by phantom line in FIG. 1, the drive drum 39 may be driven reversely to release the wire 40 in order to reduce the angle of inclination of the gangway ladder 26. In this instance, merely the angle of inclination of the gangway ladder 26 may be reduced, or alternatively the truck 22 may also be moved away from the vessel 12 since the upper subladder 28 may extend above the main deck 14 over a substantial distance.

In the embodiment described above, the lower subladder 25 is carried by the support frame 23 so as to be tiltable about the support shaft 24, but it may be fixedly mounted on the frame 23. In this instance, the lower subladder 25 may be fixedly mounted on the frame 23 with an angle of inclination which is substantially equal to the maximum angle of inclination of the gangway ladder 26, whereby the entire angle of inclination of the both ladders 25, 26 may be alleviated to facilitate stepping up and down them, even for the maximum inclination of the gangway ladder 26. While in the embodiment described above, the upper subladder 28 normally projects forwardly of the upper end of the ladder 26, the upper subladder 28 may be turned back upon the upper surface of the ladder 26 about the support shaft 29 or may be detachably secured to the ladder 26 whenever the arrangement is not in use for when setting it. After the gangway ladder 26 has been set, the upper subladder may be turned down onto the main deck 14.

What is claimed is:

1. A gangway ladder arrangement for providing a passage between a quay and a vessel, comprising; a basement frame anchored to the quay, a truck assembly mounted on the basement frame so as to be movable toward or away from the vessel, a gangway ladder having its one end supported by the truck assembly so as to be tiltable and having its other end free and curved downwardly, said downwardly curved free ladder end resting in use on the vessel and being free to move transversely across a surface of the vessel on which it is resting, and a controller for controlling the movement of the truck assembly and the tilting movement of the gangway ladder.

2. A gangway ladder arrangement according to claim 1, further including an upper subladder having its one end pivotally connected to the other end of the gangway ladder, the upper subladder being disposed so that its other end bears against a deck of the vessel and is free for movement across the deck of the vessel.

3. A gangway ladder arrangement according to claim 1, further including a lower subladder connected with said one end of the gangway ladder.

4. A gangway ladder arrangement according to claim 3 in which the lower subladder is mounted on the truck assembly so as to be tiltable relative thereto, one end of the lower subladder being connected to said one end of the gangway ladder in a manner such that it tilts in an integral manner with the gangway ladder whenever the latter assumes an angle of inclination greater than that of the lower subladder.

5. A gangway ladder arrangement according to claim 3 in which the lower subladder is mounted at an angle on the truck assembly.

6. A gangway ladder arrangement according to claim 1, further including a platform mounted on the basement frame and extending in a direction parallel to the direction of movement of the truck assembly, and a guide rail mounted on the platform, the truck assembly being adapted to move along the guide rail.

7. A gangway ladder arrangement according to claim 1 in which the controller includes a drive for causing a movement of the truck assembly, and a winch assembly for causing a tilting movement of the gangway ladder.

8. A gangway ladder arrangement according to claim 1 in which the basement frame includes a platform mounted thereon and extending in a direction parallel to the direction of movement of the truck assembly, a pair of guide rails mounted on the platform for guiding the direction in which the truck assembly moves, an endless chain disposed along each of the guide rails, and a stanchion rising to an elevation higher than the basement frame, the controller including a motor for reversibly driving the endless chain, and a winch assembly for winding up or rewinding a wire which extends through the free end of the stanchion and connected to the gangway ladder.

9. A gangway ladder arrangement according to claim 8 in which the point of connection of the wire with the gangway ladder is located between the stanchion and said one end of the gangway ladder.

10. A gangway ladder assembly, comprising:

means for defining tracks;

a truck mounted on said tracks for traveling along said tracks;

a gangway ladder having a first end portion and a curved second end portion;

mounting means pivotally mounting said gangway ladder first end portion on said truck to permit said gangway ladder to pivot about said first end portion from a position generally parallel to said tracks through a series of positions of successively stepper incline relative to said tracks, said mounting means mounting said gangway ladder with said second curved end portion curved toward said tracks, and said gangway ladder movable independently in position with said truck along said tracks and in inclination above said tracks with said gangway ladder first end portion constrained by the position of said truck and with said gangway ladder second end portion free of any constraint;

first control means for controlling the position of said truck along said tracks independently of the inclination of said gangway ladder; and second control means for controlling the inclination of said gangway ladder relative to said tracks independently of the position of said truck along said tracks.

11. A gangway ladder assembly according to claim 10, further comprising: an upper auxiliary ladder section mounted on said second end portion of said gangway ladder for pivoting relative to said gangway ladder.

12. A gangway ladder assembly according to claim 10, wherein: said mounting means comprises a lower auxiliary ladder section, said gangway ladder first end portion being mounted on said lower auxiliary ladder section to pivot through a series of positions of successively steeper incline relative to said tracks.

13. A gangway ladder assembly according to claim 12, wherein: said lower auxiliary ladder section is mounted on said truck to pivot through a series of positions of successively steeper incline relative to said tracks.

14. A gangway ladder assembly according to claim 13, wherein: said lower auxiliary ladder section and said gangway ladder first end section have confronting beveled end sections that engage when said gangway ladder is inclined above a certain inclination and whereupon further inclination of said gangway ladder is effective to further incline said lower auxiliary ladder.

* * * * *